United States Patent [19]

Van Erum

[11] Patent Number: 4,669,210

[45] Date of Patent: Jun. 2, 1987

[54] INFORMATION BOARD AND SNAP-IN PLATE USED THEREBY

[76] Inventor: Robert T. M. Van Erum, Kleine Schaluinweg 5, B-3290 Diest, Belgium

[21] Appl. No.: 829,963

[22] Filed: Feb. 18, 1986

[30] Foreign Application Priority Data

Feb. 18, 1985 [BE] Belgium ..... 2/60617

[51] Int. Cl.[4] ..... G09F 7/02

[52] U.S. Cl. ..... 40/618; 40/10 R; 40/11 R; 40/622

[58] Field of Search ..... 40/10 R, 11 R, 20 R, 40/618, 622, 584, 489

[56] References Cited

U.S. PATENT DOCUMENTS

| | | | |
|---|---|---|---|
| 1,182,145 | 5/1916 | Cornwall | 40/618 |
| 1,188,695 | 6/1916 | Star | 40/618 |
| 2,746,189 | 5/1956 | Bass | 40/618 |
| 2,879,614 | 3/1959 | Baldanza | 40/622 |
| 2,966,754 | 1/1961 | Prkin | 40/618 |
| 3,022,592 | 2/1962 | Faulkner | 40/618 |
| 3,419,979 | 1/1969 | McVicker | 40/618 |
| 4,050,920 | 12/1977 | Edwards | 40/618 |

FOREIGN PATENT DOCUMENTS 152849 12/1955 Sweden .

*Primary Examiner*—Gene Mancene
*Assistant Examiner*—Wenceslao J. Contreras
*Attorney, Agent, or Firm*—Stevens, Davis, Miller & Mosher

[57] ABSTRACT

The information board comprises a supporting board provided with grooves between which clip strips are formed, which clip strips have a groove in their lateral sides. Snap-in plates comprise a rectangular body and two backwards projecting legs having on the sides thereof facing each other two bosses. A projection is mounted, between the legs, on the body. When a snap-in plate is clipped over one or more clip strips said projection abuts against the clip-strip. The bosses enter in grooves in the lateral sides of the clip strips. By pushing on an edge of the body a leg can slide more deeply over the clip strip so that the snap-in plate tilts and snap-off.

14 Claims, 9 Drawing Figures

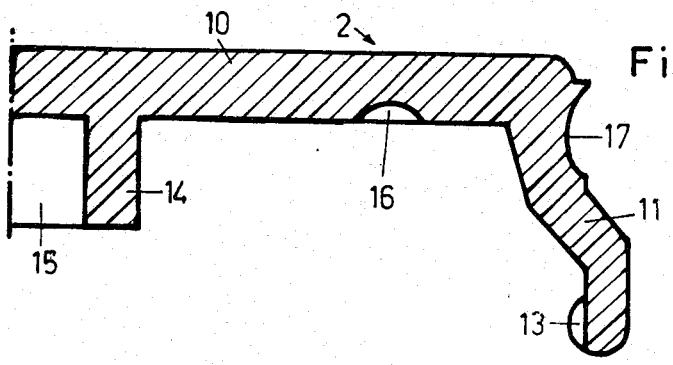
Fig. 7
Fig. 8
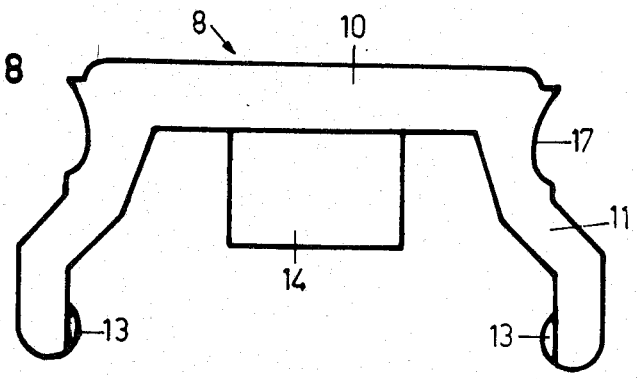
Fig. 9
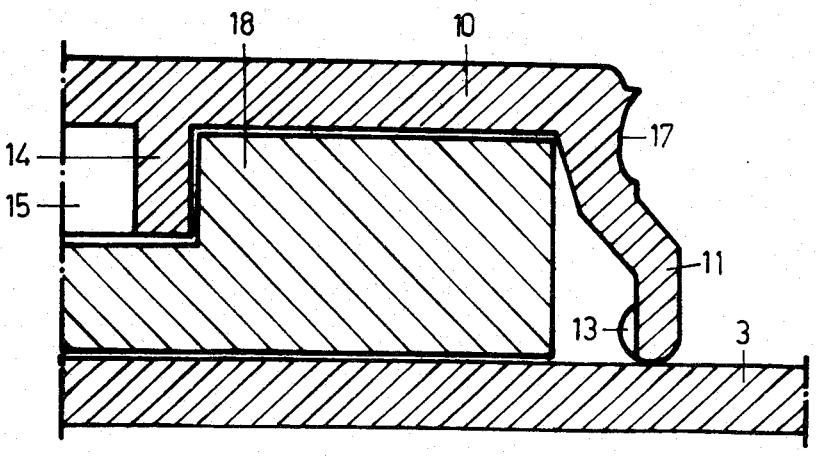

INFORMATION BOARD AND SNAP-IN PLATE USED THEREBY

BACKGROUND OF THE INVENTION

This invention relates to an information board of that type which comprises a supporting board and small replacable information-bearing snap-in plates which are removably snapped thereon, which supporting board comprises at least one clip strip which on either side thereof, that is the lateral sides thereof, has a relief, and which small snap-in plates have a body which on one side, called the front side, bears the information, and two legs which connect to said body along two mutually-opposed edges, project on the other side, called the back side, outside said body, may somewhat resiliently move away from one another, and on the sides thereof facing one another are provided with a relief which, when the snap-in plate is clipped over at least one clip strip, cooperates with a relief on a lateral side of a clip strip.

There should be understood here by "information", as well a letter, a word, a number, another sign, a colour or even the absence of a sign.

Such an information board is known from NL-A-77 13529 and is more particularly described in the embodiment as shown in FIG. 4*a* of said publication. The clipping over one or a plurality of clip strips of a snap-in plate may occur very easily. As the snap-in plates remain slidable along the clip strip lengthwise direction, it is easy to arrange a small snap-in plate with a missing letter for example, between snap-in plates already clipped on the clip strip, whereby possibly a number snap-in plates have been pushed away to make space. The snapping off of the snap-in plates is however very difficult with this known information board. The only way to snap-off the small snap-in plate is to pull the snap-in plate from the clip strip. Not only this does require relatively much force, but gripping a small snap-in plate is not easy. Due to adjacent snap-in plates, it is even sometimes impossible to grip firmly a small snap-in plate to release same. To be able to grip a small snap-in plate between other plates, it is thus first required to push away other plates and even in some cases, to slide off one or a plurality of snap-in plates in a row from the clip strip, which is very time-consuming.

The invention has now for object to obviate this drawback and to provide an information board as defined hereinabove, whereby the small snap-in plates may not only be clipped easily and fast over one or a plurality of clip strips, but may also be clipped-off and thus removed fast and easily.

THE INVENTION

For this purpose, the information board has between two mutually-opposed edges of the body of a small snap-in plate clipped over at least one clip strip, a projection lying at a distance from at least one of said side edges, the height of which projection is such that it does not prevent clipping the small snap-in plate over at least one clip strip but it forms a fulcrum about which or with which a small snap-in plate clipped over at least one clip strip is able to tilt with respect to the supporting board, while that height the snap-in plate legs project outside the body relative to the height of the relief-bearing sides of a clip strip, is so selected as to permit such tilting of the small snap-in plate, until the relief on at least one leg thereof is released from the relief on the corresponding side of a clip strip.

Such tilting may be obtained easily by pushing on said small plate adjacent said side edge of the small snap-in plate. The legs thereof resiliently move thereby away from one another.

In a particular embodiment of the invention, the projection forming a fulcrum for the tilting of the small snap-in plate lies on the back side of the snap-in plate body.

Preferably the projection has such a height that it lies substantially against at least one clip strip when the small snap-in plate is snapped over said strip.

The projection of the small snap-in plates lies usefully at a distance from both legs thereof.

The tilting may occur by pushing on the body side edge adjacent one of the legs, whereby the leg drops with or without a resilient distortion, deeper next to a clip strip, and the other leg swings frontwards and releases the relief thereof from the relief on the corresponding side of a clip strip.

Usefully the width of a small snap-in plate as measured along a direction cross-wise to the legs and next to the body, is also substantially equal to the width of that portion of the supporting board whereover the small snap-in plate snaps, and said small snap-in plate is provided on both those sides the legs lie on, with a similar relief as the lateral sides of the clip strips, in such a way that a snap-in plate may be clipped over the small snap-in plate and may be clipped-off therefrom by tilting, in the same way as it may be clipped over at least one clip strip and be clipped-off therefrom by tilting.

In a remarkable embodiment of the invention, the relief on the snap-in plate legs comprises a projecting relief, while the relief on either side of a clip strip from the supporting board is a groove.

The invention further relates to a small snap-in plate from the information board according to any one of the above-defined embodiments.

Other details and advantages of the invention will stand out from the following description of an information board and a small snap-in plate used thereby according to the invention; this description is only given by way of example and does not limit the invention; the reference numerals pertain to the accompanying drawings.

DRAWINGS

FIG. 1 is a front view of an information board according to the invention.

FIG. 2 cross-section along line II—II in FIG. 1.

Figure 6:
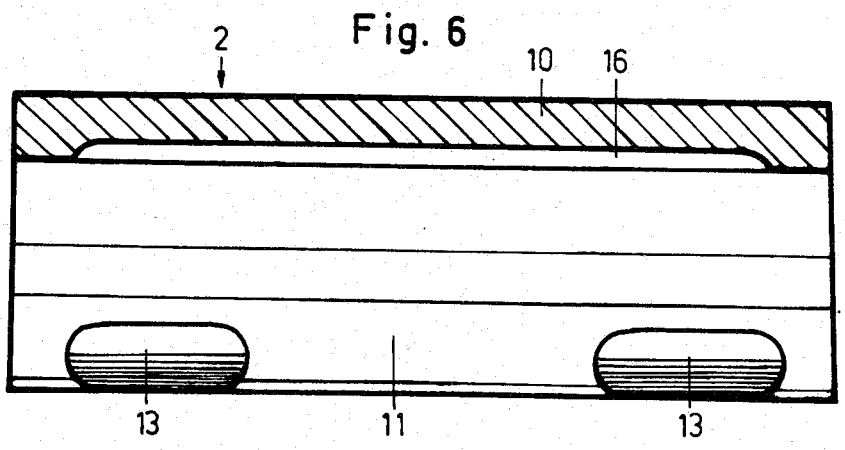
Figure 5:
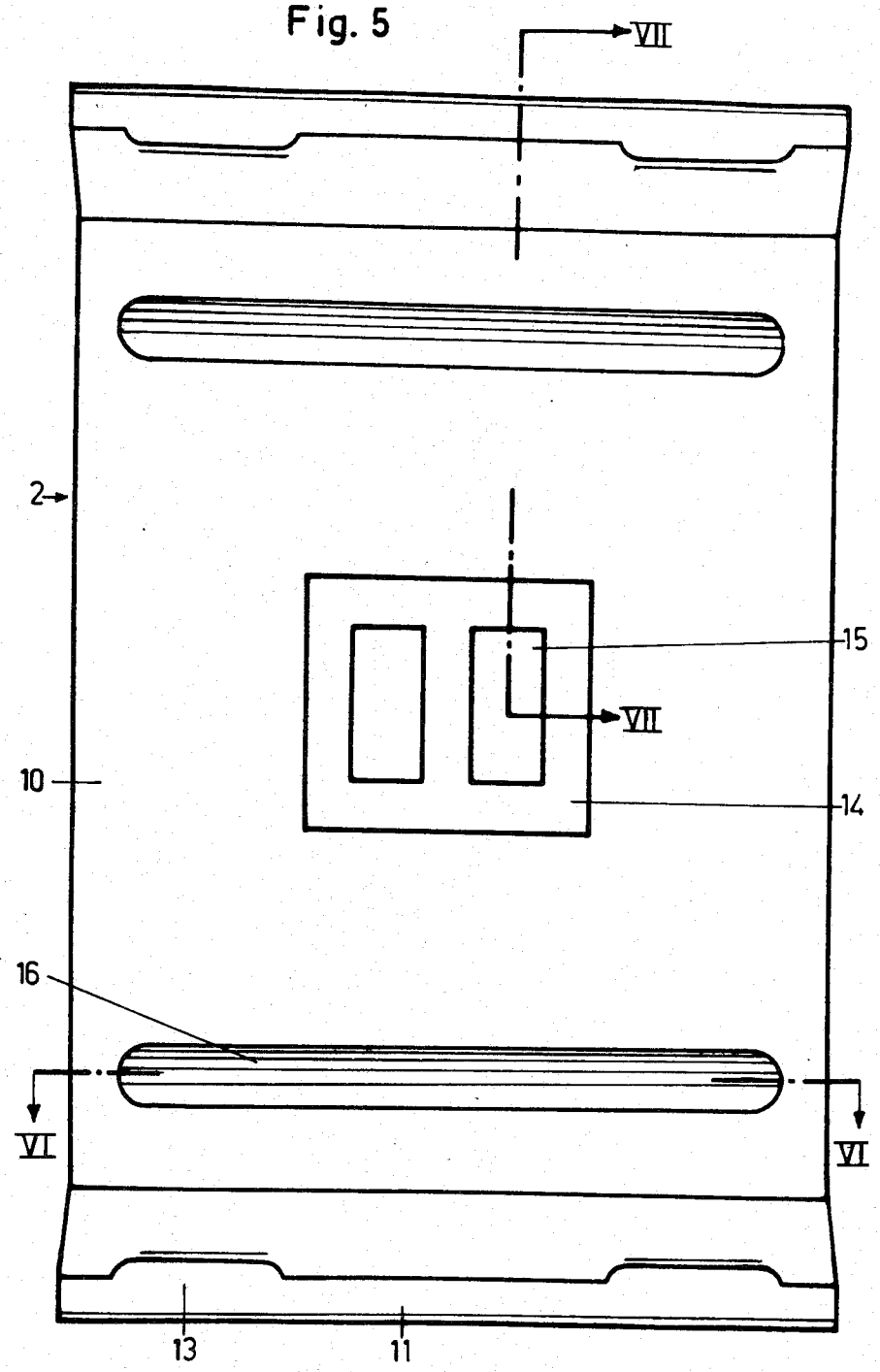
FIG. 5 is a bottom view of the small snap-in plate shown in FIG. 4.

FIG. 6 a cross-section along line VI—VI in FIG. 5.

FIG. 7 a cross-section along line VII—VII in FIG. 5.

FIG. 8 is a side view from a small snap-in plate according to the invention, but pertaining to another embodiment.

FIG. 9 a cross-section similar to the cross-section shown in FIG. 7 but corresponding to another form of embodiment of the information board.

In the various figures, the same reference numerals pertain to the same elements.

DESCRIPTION OF PREFERRED EMBODIMENTS

Figure 1:
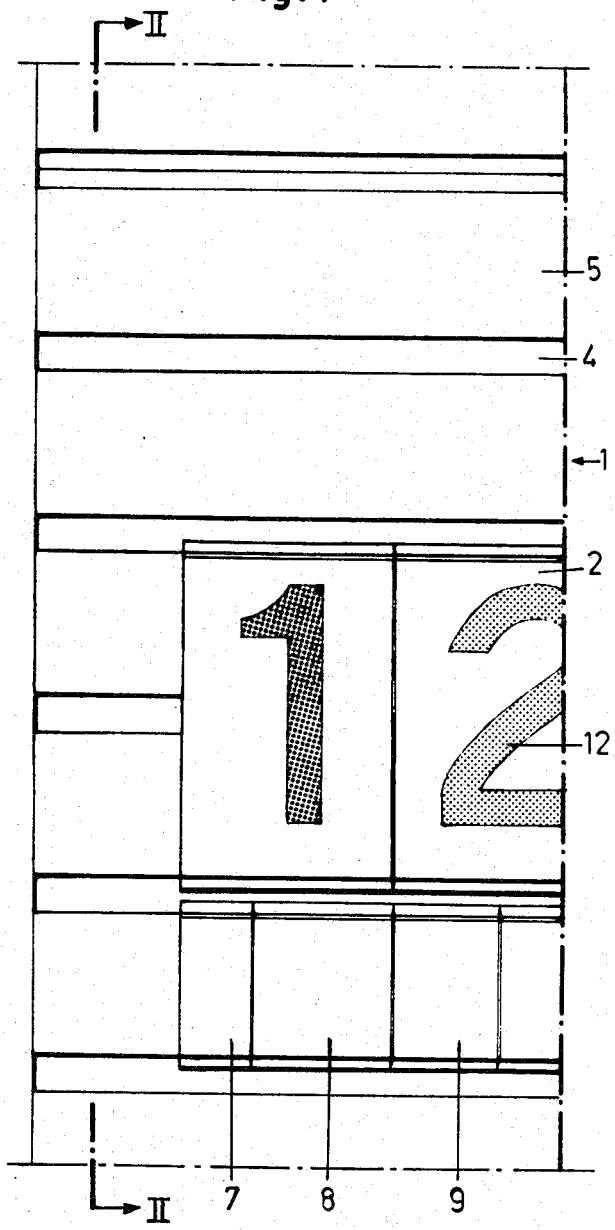
Figure 2:
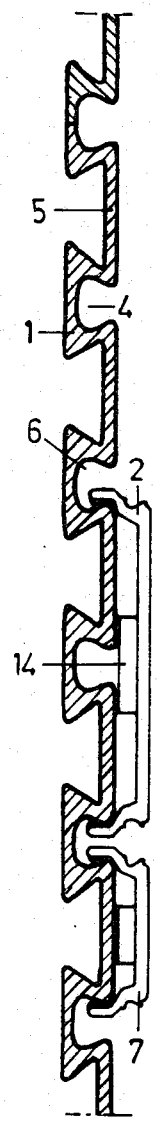
Figure 3:
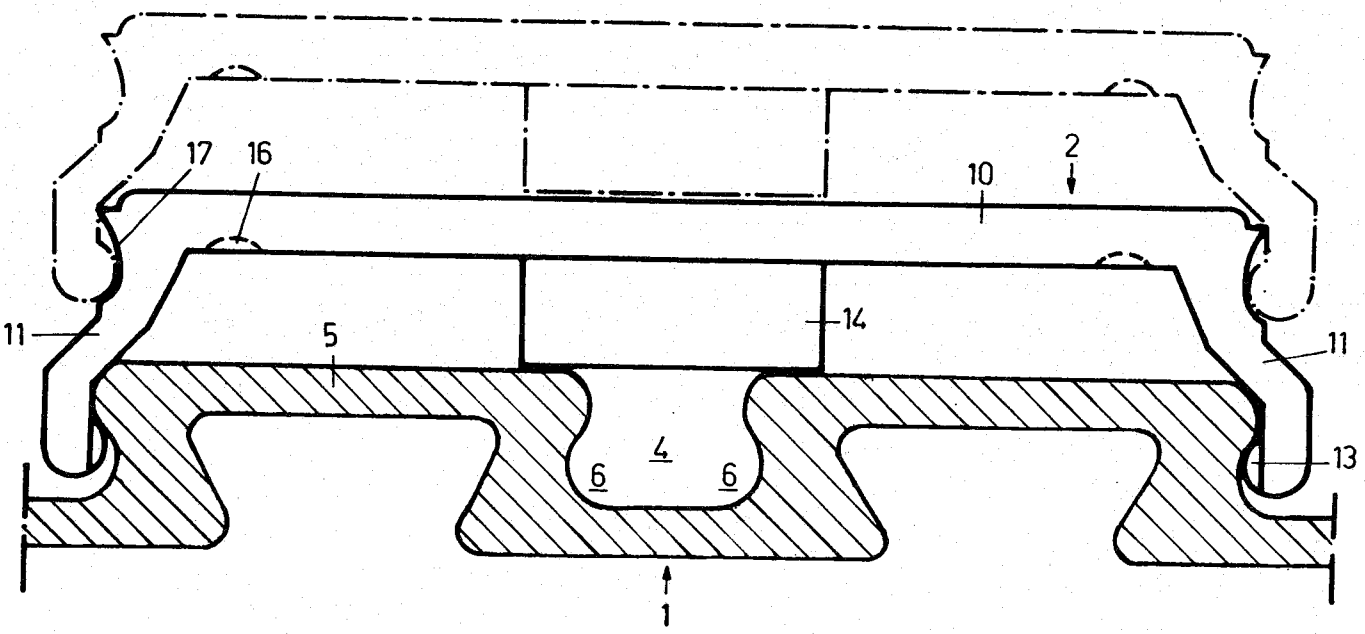
FIG. 3 shows a detail from the cross-section shown in FIG. 2, drawn on a much larger scale.
Figure 4:
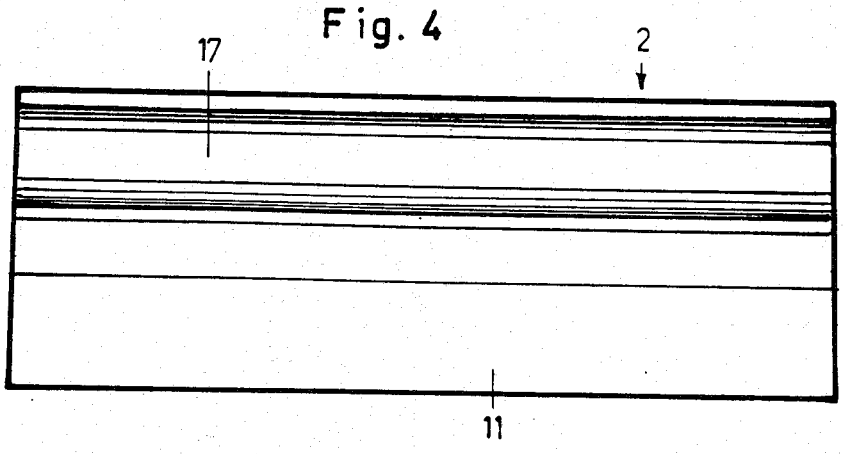
FIG. 4 is a side view from a small snap-in plate from the information board as shown in the above figures, drawn on the same scale as FIG. 3.

The information board as shown in FIGS. 1 to 3 is mainly comprised of a supporting board 1 and a number small snap-in plates 2, 7, 8 and 9 which may be removably and replacably clipped on said supporting plate 1.

The supporting board 1 is intended to be hung on a wall and said supporting board is provided therefor with fastening means not shown in the figures. The supporting plate may also be surrounded with a frame and be covered on the front side with a removable transparent panel.

The supporting board 1 is formed by an aluminium sectional shape and is provided with five grooves 4 extending over the whole length thereof.

The grooves 4 as considered from the front side, that is the side shown in FIG. 1, towards the bottom thereof, first decrease in width and thereafter increase in width. The grooves 4 have namely a cross-section in the shape of a reversed mushroom.

In this way between the adjacent grooves 4 and between the outermost grooves 4 and the outermost lengthwise edges of each sectional shape 3, clip strips 5 are formed, which are provided in both lateral sides thereof and at a distance from the front side, with a radiused groove 6.

The supporting board 1 is hung with the grooves 4 directed horizontally. The lengthwise direction of said grooves 4 will then also be called hereinafter the horizontal direction.

The small snap-in plates 2 from the information board as shown in FIGS. 1 to 3, one of which plates is shown in detail in FIGS. 4 to 7, comprise a disk-like rectangular body 10 and two legs 11 projecting outwards said body 10 on the back side, which connect to two mutually-opposed edges of said body 10.

The small snap-in plate 2 is manufactured completely from synthetic material, in such a way that the legs 11 may spread somewhat resiliently from one another.

Said body 10 is provided on the flat front side thereof with an information 12. With some small snap-in plates, such as shown in the figures, this information is a digit. With other snap-in plates, said information 12 may be a letter, a punctuation mark or another symbol sign. For some snap-in plates 2 which mark a space, the body 10 is blank on the front side and the information is the absence of any sign. The letters, digits or signs are provided on said body 10 by painting or printing, they are formed by a relief on said side, or they are incorporated in the synthetic material itself.

The legs 11 connect with an outward-slanting part to two mutually-opposed edges of said body 10. Said latter part merges into a part extending cross-wise to body 10, the outer side of which lies thus more outward than said body 10. Said latter parts of both legs 11 are provided next to the ends thereof, on those sides facing one another, with two projecting bosses 13 which are somewhat smaller than grooves 6.

The spacing between said legs 11 as measured in the location of said bosses 13, is somewhat narrower than the total width of two adjacent clip strips 5 with the groove 4 thereof lying therebetween.

Said latter width is moreover equal to the widest width of said body 10 as measured cross-wise to legs 11.

By means of a resilient distortion of said legs 11, a small snap-in plate 2 may be clipped simultaneously over two adjacent clip strips 5, as clearly visible in FIG. 3.

During such clipping, the bosses 13 on the ends of both legs 11 spring over the widest part lying on the front side of the pair of clip strips 5. When the small snap-in plate 2 has been clipped over said part of clip strips 5, the bosses 13 lie inside the outermost grooves 6 of said pair of clip strips 5.

In said latter position, that is the position as shown in FIGS. 1 to 3, the small snap-in plate 2 engages with a projection 14, the front side of the supporting board 1.

Said projection 14 lies in the center of body 10 and has substantially the shape of a parallelepiped. The sides thereof in parallel relationship with legs 11 have a length which is approximately $\frac{1}{3}$ of the width of body 10 as measured along the same direction. The length of those sides of projection 14 cross-wise to legs 11, have a length which is approximately to $\frac{1}{4}$ of the length of body 10 as measured along the same direction. Said length is however longer than the width as measured on the front side of grooves 4 between the clip strips.

Relative to body 10, the height of projection 14 is lower than the height of legs 11. The height is however such that when the small snap-in plate 2 is clipped with legs 11 over the pair of clip strips 5, said projection 14 engages the front side of said clip strips and thus prevents pushing the small snap-in plate deeper over the clip strips 5.

To spare material, said projection 14 is provided with two hollowings 15.

The spacing between legs 11 of said small clip plate 2 is such that even when said small plate is clipped over the pair of clip strips 5, said legs 5 are still very slightly pressed away from one another. The small snap-in plate 2 thus lies with some stress on the supporting board 1, whereby it remains well in the position thereof but if still slidable.

The depth of grooves 4 between the clip strips 5, which depth thus corresponds to the height of said clip strips 5, is somewhat greater than the distance said legs 11 project outside projection 14, or in other words slightly greater than the difference between the height of legs 11 relative to body 10, and the height of projection 14.

This thus means that the legs 11 from a small snap-in plate 2 clipped over two clip strips 5 do not extend down to the bottom of said grooves 4 on either side of said pair clip strips 5.

The grooves 6 which are provided on either side in the lengthwise upstanding sides of a clip strip 5, connect to the bottom of grooves 4 and as already stated, they are larger than the projecting bosses 13 from a small snap-in plate 2, which bosses lie frontward inside the corresponding groove 6 thereof when the small snap-in plate 2 is clipped over the pair clip strips 5 and the projection abuts against the clip strips 5.

There results from the above that in spite of the fact that the small snap-in plate 2 clipped over a pair clip strips 5 is not pushable deeper over said pair clip strips 5 due to the projection 14, said small snap-in plate may however tilt, whereby the projection 14 forms the bearing a fulcrum wherewith the small snap-in plate bears on the pair clip strips 5. To obtain such tilting, it is necessary to press the small snap-in plate next to the projection 14. Pressing may occur adjacent an edge which runs cross-wise to said legs 11. Adjacent said edge, the legs 11 are pushed deeper inside grooves 4 while on the edge opposite thereto, the legs 11 come forward, which means they are pushed due to resilient distortion, out of the grooves 6, whereby the small snap-in plate 2 is clipped off.

The pushing preferably occurs on one of those edges a leg 11 connects to. This leg then enters deeper in the groove 4 it lies in, which occurs easily due to that groove 6 wherein the bosses 13 on said leg lie in, being larger than said bosses. The leg 11 lying opposite thereto is pushed frontwards and the bosses 13 on said leg leave due to resilient distortion of the leg, the corresponding groove 6. In this way also the small snap-in plate 2 is thus clipped off.

To make such clipping-off easier in those cases where said latter clipping-off process is used, there is provided in the back side of body 10 between the projection 14 and each leg 11, a groove 16 which extends over nearly the whole width of body 10 in parallel relationship with legs 11. Due to the grooves 16, the resiliency of the small snap-in plate 2 is increased.

As considered at right angle to the legs 11, the small snap-in plate 2 has over a height which substantially corresponds to the depth of a groove 4 from the supporting board 1, the same width as that unit formed by a pair clip strips 5. A small snap-in plate 2 is provided on both sides where said legs 11 are arranged, with a groove 17 the position of which with respect to the front side of the body 10 corresponds to the position of grooves 6 with respect to the front side of the clip strips 5. Said groove 17 is great enough to receive a boss 13. This thus means that as considered cross-wise to legs 11, the uppermost part of said small snap-in plate 2 has a similar outer shape as that pair clip strips 5 it is clipped over, the middle groove 4 between both clip strips from the pair not included.

This results in making it possible to clip over a first small snap-in plate 2, a second identical small snap-in plate 2 and to clip same off therefrom in the same way as the first small snap-in plate 2 may be clipped over a pair clip strips 5 or clipped off therefrom.

In FIG. 3, such a second small snap-in plate 2 is shown in dot-and-dash lines clipped over a small snap-in plate 2 already clipped on the supporting board 2. The projection 14 of the first mentioned small snap-in plate 2 nearly abuts the body 10 of the last mentioned small snap-in plate 2. The legs of said first mentioned plates 2 extend along the body 10, with the bosses 13 on its legs 11 in the grooves 17, of said last mentioned plate 2. By pushing near one leg on the body of the first mentioned plate 2, said leg difforms and moves backwards along the corresponding leg of the last mentioned plate 2 and the opposite leg 11 of said first mentioned plate 2 moves frontwards and snaps off the last mentioned plate 2.

When some particular information only has to be replaced temporarily by another one, it is possible in this way to leave the small snap-in plate 2 with said first information on the supporting board and to clip a second small snap-in plate 2 with the new information on said first small snap-in plate 2.

It is not required that the small snap-in plates may be clipped only over two adjacent clip strips 5. The information board may also or exclusively comprise small snap-in plates 2 which may be clipped over but one single clip strip 5 or simultaneously over more than two clip strips 5, or it may comprise a mixture of small snap-in plates 2 of various size.

The small snap-in plates 7, 8 and 9, one of them being shown in detail in FIG. 8 differ from the above-described snap-in plate 2 FIGS. 1 to 7 refer to, by the size of the body 10 thereof which is such that said small snap-in plates can be clipped over a single clip strip 5. Due to the relatively small spacing between legs 11, the projection 14 on the back of said body 10 is also smaller.

After being clipped on the supporting board 1, the small snap-in plates 2, 7, 8 or 9 still always remain slidable along the horizontal direction. This allows an accurate lining-up along the vertical direction.

When there should be removed from a formed line with a message, one or more small snap-in plates 2, 7, 8 or 9, such removing may occur easily by tilting same, even when said small snap-in plates are surrounded by other ones. The small snap-in plates lying on the one side of the removed small snap-in plate 2 may when required, be pushed up without having to remove same from the supporting board.

The addition of a further small snap-in plate 2, 7, 8 or 9 in a row may also occur easily. As far as required, the last small plate is removed from the row and the small snap-in plates are slid horizontally to make place for the small snap-in plate to be added.

The above-described small snap-in plates 2, 7, 8 or 9 may also be clipped over other small plates which are not snap-in plates but only differ from such snap-in plates in the projection being replaced by a magnet. Said latter small magnetic plates may cooperate with a metal supporting board, for example a flat one.

The small snap-in plates 2, 7, 8 or 9 may also as shown in FIG. 9 be provided without any other constructive modification with a piece of magnetic material 18, with which they can cooperate directly but without snapping with a metal supporting board 3. The piece of magnetic material 18 is clamped between the projection 14 and the two legs 11 of the snap-in plates 2, 7, 8 or 9.

The invention is in no way limited to the above-described embodiments, and within the scope of the patent application, many changes may be brought to the described embodiments, notably as regards the shape, the composition, the arrangement and the number of the components being used to embody the invention.

More particularly, each small snap-in plate does not necessarily have to be provided with a single writing sign. Not only some small snap-in plates may be blank, but also some small snap-in plates may comprise a plurality of writing signs or even a complete word. In this latter case, the small snap-in plates have a markedly longer length than the above-described ones.

Boths legs from the small snap-in plates do not necessarily have to be integral as described. Such legs may be broken off and be comprised of two or a plurality of discrete leg parts, which naturally connect to the same body edge and extend along the same direction.

The projection on the back side of the body of each small snap-in plate has not necessarily to be in the shape of a parallelipiped. Said projection may be limited to a thin rib for instance perpendicular to the legs or may be round.

I claim:

1. An information board of that type which comprises a supporting board or plate and small replacable information-bearing snap-in plates, which supporting board comprises at least one clip strip which on either side thereof, that is thus on the lateral sides thereof, has a relief, and which small snap-in plates comprise a body having two mutually-opposed edges, which body bears on one side, called the front side, information, said snap-in plates further comprising two legs which connect to said body along two mutually-opposed edges, project on the other side, called the back side, outside said body, may be spread somewhat resiliently from one another and are provided on sides thereof facing one another, with a relief which when the small snap-in plate is clipped over at least one clip strip, cooperates with the relief on a lateral side of a clip strip, which information board has between two mutually-opposed edges of the body of a small snap-in plate clipped over at least one clip strip, a projection lying at a distance from at least one said edges, the height of which projection is so designed that it does not prevent the small snap-in plate being clipped over at least one clip strip, but forms a fulcrum about which or with which a small snap-in plate clipped over at least one clip strip is able to tilt relative to the supporting board , while that height the snap-in plate legs extend outside the body relative to the height of the relief-bearing sides of a clip strip, is so selected as to permit tilting of the small snap-in plate until the relief of at least one of said legs thereof is released from the relief on the corresponding side of a clip strip.

2. An information board as defined in claim 1, in which the projection forming a fulcrum for the tilting of the small snap-in plate lies on the back side of the small snap-in plate body.

3. An information board as defined in claim 2, in which the projection has such a height that it lies substantially against at least one clip strip when the small snap-in plate is snapped over said strip.

4. An information board as defined in claim 2, in which the projection of the small snap-in plates lies at a distance from both legs thereof.

5. An information board as defined in claim 4, in which the body of the small snap-in plates is rectangular, with two edges in parallel relationship with said legs, and the projection on the small snap-in plates lies at a distance from the edges of the body as well in the direction in parallel relationship with the legs as in the direction cross-wise to the legs.

6. An information board as defined in claim 4, in which the body of the small snap-in plates is provided on the back side thereof, between the projection and each of said legs, with a groove which extends in parallel relationship with the legs.

7. An information board as defined in claim 2, in which the width of a small snap-in plate as measured along a direction cross-wise to the legs and next to the body, is substantially equal to the width of that portion of the supporting board whereover the small snap-in plate may be clipped, and said small snap-in plate is provided on both those sides the legs lie on, with a similar relief as on the lateral sides of the clip strips, in such a way that a small snap-in plate may be clipped over said small snap-in plate and may be clipped-off therefrom in the same way as it may be clipped over at least one clip strip and be clipped-off therefrom by tilting.

8. An information board as defined in claim 1, which comprises a plurality of clip strips which are separated from one another by grooves in said supporting board, whereby the depth of said grooves is deeper than the difference between the height of the legs of the small snap-in plates relative to the body, and the height of said projection.

9. An information board as defined in claim 1, in which the relief on the legs of the small snap-in plates is a projecting relief, while the relief in both lateral sides of a clip strip of the supporting board is a recessed relief.

10. An information board as defined in claim 9, in which the legs of the small snap-in plates bear on the ends thereof and on the sides thereof facing one another, two bosses.

11. An information board as defined in claim 7, in which the spacing between the projecting relief of the legs lying opposite one another of a small snap-in plate is such that said legs are still spread from one another with some strain when the small snap-in plate has been clipped over at least one clip strip and the projecting relief enters the corresponding recessed relief in a lateral side of a clip strip, whereby said strain is low enough to still allow sliding the small snap-in plate along the lengthwise direction of the clip strips.

12. An information board as defined in claim 1, in which the legs lying opposite one another from the small snap-in plates connect to outermost edges of the body, but lie with the ends thereof more outwards than said edges.

13. Small snap-in plate from the information board as defined in claim 1.

14. Small snap-in plate as defined in claim 13, which comprises a substantially quadrangular body with two mutually-opposed edges, two legs connecting to said two mutually-opposed edges thereof, which legs are provided on the sides facing one another thereof and next to the ends thereof, with a relief, and a projection which stands between said legs on the back side of the body.

* * * * *